US005551758A

United States Patent [19]

Leib et al.

[11] Patent Number: 5,551,758

[45] Date of Patent: Sep. 3, 1996

[54] DURABLE PATIENT CHAIR

[75] Inventors: Roger K. Leib, Los Angeles; James L. Reinis, Culver City, both of Calif.

[73] Assignee: Roger and Bonita Lieb Trust, Los Angeles, Calif.

[21] Appl. No.: 320,605

[22] Filed: Oct. 11, 1994

Related U.S. Application Data

[63] Continuation-in-part of Ser. No. 160,921, Nov. 30, 1993, abandoned.

[51] Int. Cl.[6] ..... A47C 1/02

[52] U.S. Cl. ..... 297/451.3; 297/285; 297/411.42; 297/452.39

[58] Field of Search ..... 297/285, 294, 297/295, 302.1, 302.3, 411.42, 445, 447, 448, 452.18, 452.19, 452.39

[56] References Cited

U.S. PATENT DOCUMENTS

| | | | |
|---|---|---|---|
| D. 267,757 | 2/1983 | Leib . | |
| D. 318,578 | 7/1991 | Leib . | |
| D. 323,250 | 1/1992 | Leib . | |
| 2,064,424 | 12/1936 | Gittings | 297/411.42 X |
| 2,122,935 | 7/1938 | Fleisher | 297/411.42 X |
| 2,979,122 | 4/1961 | Knoll | 297/445 |
| 4,529,246 | 7/1985 | Leib . | |
| 4,555,139 | 11/1985 | Leib . | |
| 4,595,235 | 6/1986 | Leib . | |
| 4,784,435 | 11/1988 | Leib . | |

*Primary Examiner*—Peter R. Brown
*Attorney, Agent, or Firm*—Steven G. Roeder; Sheldon & Mak, Inc.

[57] ABSTRACT

A durable patient chair (10) comprises a chair base frame (12) including a pair of substantially rigid, spaced apart, front legs (22); a pair of brackets (14), each bracket (14) being fixedly attached to each front leg (22) and has a downwardly extending lip (42) and a horizontal portion (44); a rearwardly extending resilient seat (16) having a front edge with a downwardly extending lip (56) for attachment to the brackets (14); and a pair of first fasteners (18) for attaching the downwardly extending lip (42) of the bracket (14) to the downwardly extending lip (56) of the seat. Preferably, a second fastener (20) is used for attaching the horizontal portion (44) of the bracket (14) to an outer surface of the seat (16) proximate to the front edge (53) to better secure the seat (16) to the bracket (14). The seat (16) only has apertures for mounting the seat (16) to the bracket (14) in the downwardly extending lip (56) and does not have apertures for mounting the seat (16) to the bracket (14) in the horizontal portion of the seat (16). Thus, the seat (16) is less affected by excessive flexing and loading.

23 Claims, 2 Drawing Sheets

DURABLE PATIENT CHAIR

This Application is a continuation-in-part of application Ser. No. 08/160,921, filed Nov. 30, 1993 now abandoned.

BACKGROUND

This invention is directed to a durable patient chair, particularly suited for use by weakened, partially disabled, or infirm individuals.

Individuals suffering from various musculoskeletal conditions or neuromuscular disorders have unique needs with respect to a chair. A chair for such an individual must be comfortable for long periods of time, must provide easy ingress and egress, and must provide a stable base of support.

A patient chair which satisfies these needs is described in U.S. Pat. No. 4,784,435, to Leib, which is incorporated herein by this reference. The patient chair disclosed in U.S. Pat. No. 4,784,435 has front legs, a rearwardly extending, substantially horizontal seat, and brackets attached to the legs and seat for cantilevering the seat from the front legs. Bolts are used to attach the brackets to the seat.

However, with this type of chair, excessive and prolonged rocking of the cantilevered seat by obese users can limit the life of the chair due to excessive stress in the spring frame of the seat at the perforation for the attachment between the spring frame and bracket.

Accordingly, there is a need for a patient-type chair which is comfortable for long periods of time, provides easy ingress and egress, a stable base for support, and has extended durability for the broadest spectrum of users. Further, the chair must be easy to assemble to keep the cost of the chair at a minimum, aesthetically pleasing, and streamlined to the exclusion of any dirt catching clamps or other conventional assembly devices.

SUMMARY

The present invention is directed to a chair that meets these needs. A chair according to the present invention comprises (i) a chair base frame including a pair of substantially rigid, substantially vertical front legs which are spaced apart from each other, (ii) a rearwardly extending seat, (iii) a pair of brackets fixedly attached to the front legs for cantilevering the seat from the front legs, and (iv) a pair of first fasteners for attaching the seat to the brackets. Preferably, to assist in preventing the seat from flexing upwardly, a pair of second fasteners can also be used to attach the seat to the brackets. As described below, the brackets and seat are uniquely configured and attached to extend the durability of the chair when subjected to excessive rocking and loading.

The seat is substantially horizontal and is made for supporting the human body in a seated position. The seat has a front edge with a downwardly extending lip and can comprise of a pair of substantially parallel, substantially resilient side members and a seat cover attached horizontally between the side members. Each side member is fixedly attached to one of the brackets and typically is constructed of spring steel.

Further, a backrest can be affixed to the seat at a rear edge and extend vertically above the seat for providing support for an individual sitting upon the seat. Typically, the seat and backrest are formed from a continuous pair of L-shaped resilient side members with the seat cover attached horizontally between the side members and a backrest cover attached vertically between the side members.

The brackets are designed to avoid creating high stress areas between the seat and the brackets which can reduce the durability of the seat. Each bracket is fixedly attached to one of the front legs, i.e., by welds, has a downwardly extending lip which corresponds to the downwardly extending lip of the seat, and a rearwardly extending substantially horizontal portion. The downwardly extending lip of one of the brackets is attached to the downwardly extending lip of the seat with the first fastener, while the horizontal portion of one of the brackets is attached to an outer surface of the seat with the second fastener, proximate to the front edge of the seat.

For example, in one version of the first fastener, the downwardly extending lip of each bracket and the downwardly extending lip of each of the side members can include a lip aperture extending therethrough with the first fastener being positioned in one of the lip apertures. In this version, each lip aperture comprises a bracket lip aperture which extends through the bracket and a seat lip aperture which extends through the seat. Optimally, the first fastener is fixedly positioned in the seat lip aperture and includes a spacer which extends rearwardly from the seat lip aperture, and the bracket lip aperture is a slot which has a larger cross-sectional area than the spacer to allow for easy insertion of the spacer into the bracket lip aperture. Alternatively, in a second version, the first fastener can include a bolt fixedly attached, i.e., by welding, to the downwardly extending lip of each bracket, the bolt extending through a seat lip aperture in the downwardly extending lip of each side member.

The horizontal portion of each bracket can include a bracket aperture extending therethrough, and the second fastener can be fixedly positioned in the bracket aperture and fixedly adhered to an outer, bottom surface of one of the side members by an adhesive or other means which does not reduce the cross-sectional area of the side member. Thus, the only apertures in the side members for mounting the side members to the bracket are in the downwardly extending lip of the seat and no mounting apertures are located in the horizontally extending portion of the side members, in high stress areas, which can weaken the side members.

The second fastener can comprise a mounting insert, a mounting plate attached to the outer, bottom surface of one of the side members by the adhesive, a bumper or other resilient load dispersing and cushioning device, and a rear screw. The mounting plate is a flat plate having a mounting aperture which holds and secures the mounting insert perpendicular to the outer, bottom surface of the respective side member.

Typically, the bumper is resilient and positioned between the horizontal portion of the bracket and the seat. The bumper encircles and is held in position by the mounting insert. The rear screw extends upwardly through the bracket aperture and threads into the mounting insert to assist in securing the side member to the bracket.

The adhesive can be provided by any type of adhesive and specifically by a flexible adhesive strip or a piece of double-sided tape positioned between the mounting plate and the side member which holds the mounting plate to the outer, bottom surface of the side member. Optimally, single-side tape can be wrapped around the side member and the mounting plate to ensure reliable adhesion between the mounting plate and the side member.

The present invention provides a patient chair with a significantly stronger and more durable seat since the seat only has apertures for attaching the seat to the brackets in the downwardly extending lip and not in the horizontal portion of the seat. Therefore, the seat is more resistant to excessive loading, bending and flexing of the seat. Further, the first and second fasteners are aesthetically invisible and allow for quick and easy assembly of the seat to the brackets.

DRAWINGS

These and other features, aspects, and advantages of the present invention will become better understood from the following description, appending claims and accompanying drawings where:

DESCRIPTION

Figure 1:
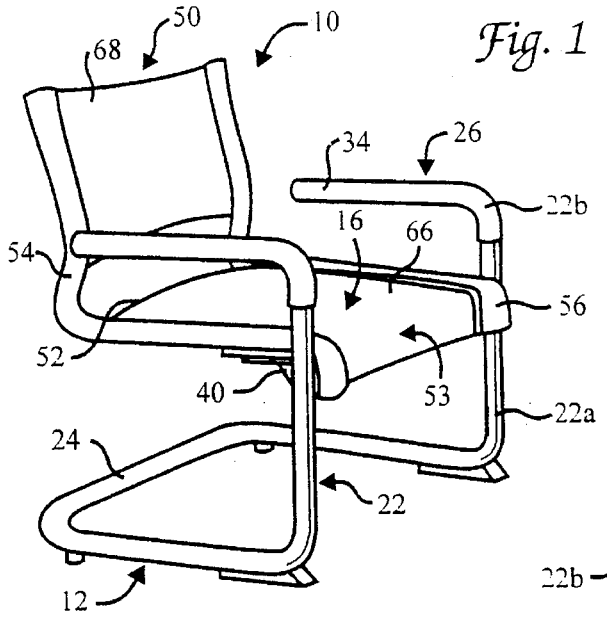
FIG. 1 is a perspective view of a chair having features of the present invention.
Figure 2:
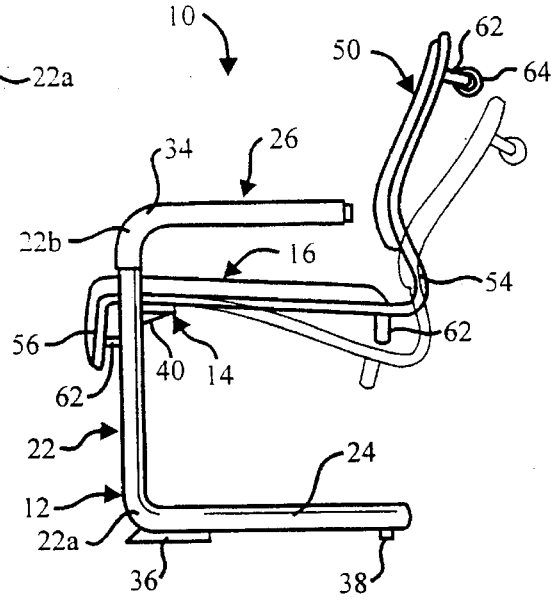
FIG. 2 is a side plan view of the chair of FIG. 1.

A chair 10, according to the present invention, comprises a chair base frame 12, brackets 14, at least one seat 16, first fasteners 18, and second fasteners 20. The brackets 14 attach and cantilever the seat 16 to the chair base frame 12.

The design of the chair base frame 12 varies and includes at least two front legs 22 which are substantially rigid, substantially vertical, and are spaced apart from each other. As shown in FIG. 1, the chair base frame 12 includes (i) a rearwardly-extending U-shaped base member 24, which is attached to a bottom 22*a* of each front leg 22, and (ii) armrests 26, which extend rearwardly and horizontally from a top 22*b* of each front leg. The U-shaped base member 24 supports the front legs 22 in a substantially vertical position and apart from each other, while the armrests 26 provide support for the user of the chair 10.

Figure 3:
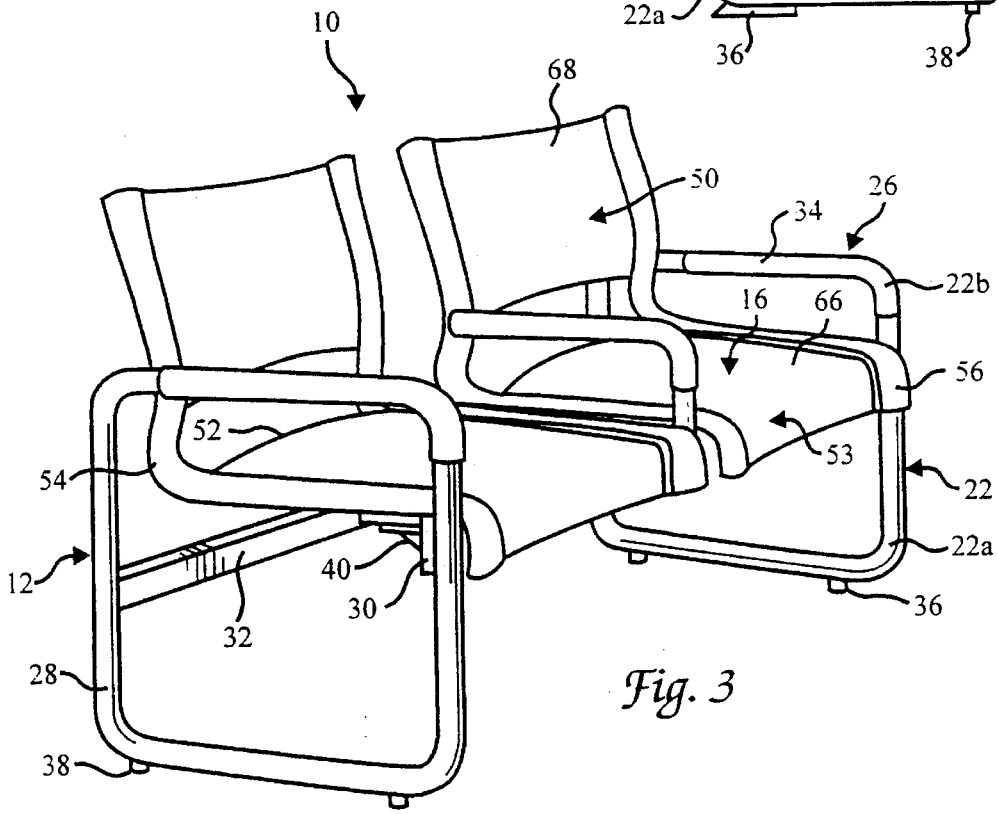
FIG. 3 is a perspective view of a second chair having features of the present invention.

In a second version, as shown in FIG. 3, the chair base frame 12 can include a pair of C-shaped base members 28, each attached to the top 22*b* and bottom 22*a* of one of the front legs 22 and a horizontal cross-beam 30 attached to the C-shaped base members 28 or the front legs 22 for holding the front legs 22 in the proper relative position. In this version, the upper portion of the C-shaped base member 28 forms the armrest 26. Further, additional support beams 32 can be added between the front legs 22 and/or the C-shaped base members 28 for additional support, and additional armrests 26 can be positioned between each seat 16 and be attached to the chair base frame 12. Alternatively, many other styles of chair base frames 12 are available. For example, the chair base frame 12 could have four legs.

The chair base frame 12 is constructed of a suitable construction material such as tubular steel which is bent to form the chair base frame 12. Alternatively, the chair base frame 12 can be made from a laminated wood. Further, the armrest 26 can include arm cushions 34 made of a soft compressible material such as vinyl plastisol installed around the armrests 26 for the comfort of the user.

Optimally, glides 36 are attached to the underside of forwardmost bottom ends of the chair base frame 12 to restrict the chair 10 from tipping in the forward direction. Typically, the glides 36 are a hollow wedge which is affixed to the chair base frame 12 by rivets, screws, bolts, welds, or any other method familiar to those skilled in the art. Further, a rear glide 38 can be placed at the rearwardmost bottom ends of the chair base frame 12 to inhibit scratching of the floor surface (not shown).

Each bracket 14 is fixedly attached to the chair base frame 12, i.e., one of the front legs 22 as shown in FIG. 1, and/or the cross-beam 30 as shown in FIG. 3. Typically, the bracket 14 is made of steel which is welded to the chair base frame 12. Optimally, a gusset 40 is welded underneath the bracket 14 to provide additional rigidity to the bracket 14.

Each bracket 14 has a downwardly extending lip 42 with a rearwardly extending substantially horizontal portion 44. Typically, the transition between the horizontal portion 44 and the downwardly extending lip 42 is arced to prevent cracking during manufacturing and enable the seat 16 and the bracket 14 to nest together. A suitable radius of the arc is about 0.5 inches. Further, the bracket 14 can include a bracket lip aperture 46 extending through the downwardly extending lip 42 and a bracket aperture 48 extending through the horizontal portion 44. The bracket lip aperture 46 is a hole or slot sized to fit the first fastener 18. Similarly, the bracket aperture 48 is a hole or slot sized to fit the second fastener 20. Optimally, the bracket lip aperture 46 is a slot having a cross-section which is larger than the first fastener 18 to allow for misalignment of the chair base frame 12 and/or the seat 16 and to allow for quick assembly of the seat 16 to the chair base frame 12 because the first fastener 18 can be quickly inserted into the bracket lip aperture 46.

The seat 16 is rearwardly extending, substantially horizontal and made for supporting a human body in a seated position. Preferably, a backrest 50 extends upwardly and vertically from a rear 52 of the seat to provide back support for a human. Each seat 16 is affixed at a front edge 53 of the seat to the bracket 14 which, in turn, is affixed to the chair base frame 12. Depending upon the embodiment, the seat 16 can be wide and can be capable of supporting at least two human bodies in the side-by-side seated position. Further, multiple seats 16 can be attached to the chair base frame 12 by multiple pairs of brackets 14.

Typically, the seat 16 and backrest 50 are formed from a pair of continuous, substantially parallel, L-shaped resilient side members 54. Each side member 54 can be formed of a bar stock of a steel alloy, heat treated and tempered to have spring action mechanical properties such as spring steel.

Figure 4:
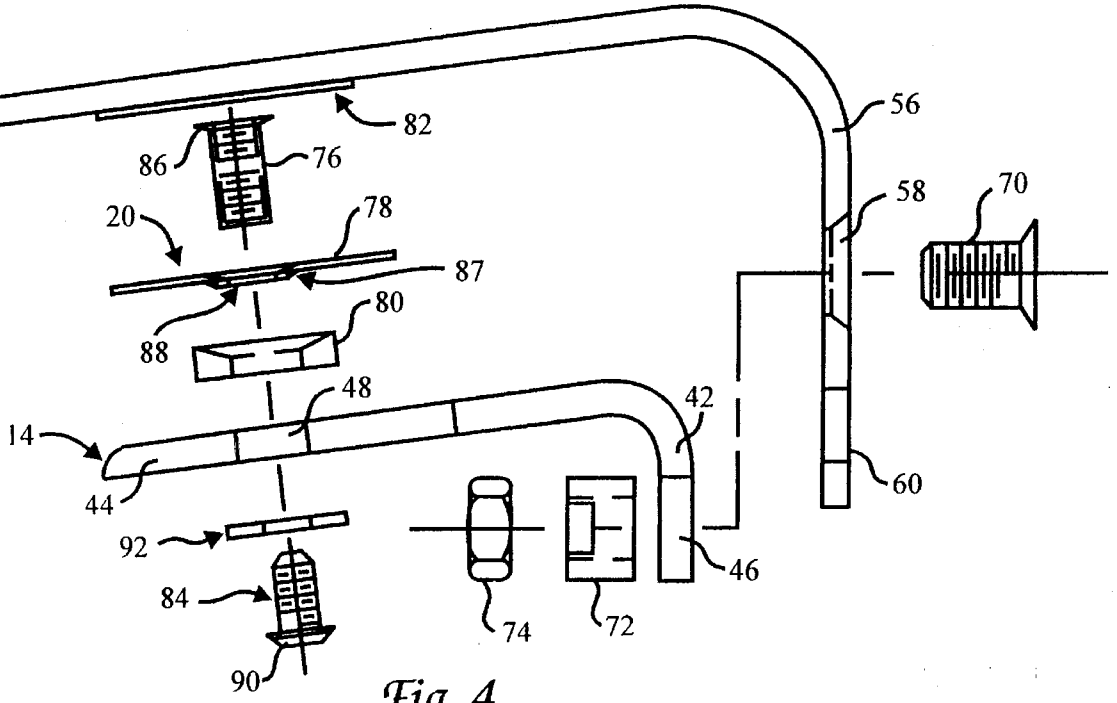
FIG. 4 is a side plan section assembly view of one of the side members and one bracket.
Figure 5:
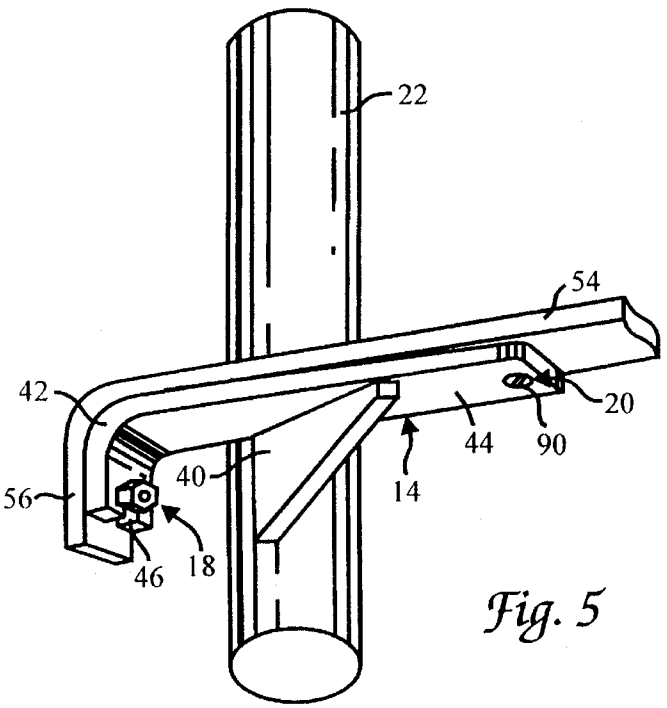
FIG. 5 is a perspective section view of one of the side members attached to one racket.

As shown in FIGS. 4 and 5, a front end of each side member 54 has a downwardly extending lip 56 which corresponds with the downwardly extending lip 42 of the brackets. Similarly, the transition before the lip 56 is arced and corresponds with the bracket 14 to prevent concentrated stress areas. Further, at least one seat lip aperture 58 extends through the downwardly extending lip 56 of each side member which corresponds and aligns with the bracket lip apertures 46. The seat lip aperture 58 typically is a countersunk hole or slot sized to fit the first fastener 18.

A second seat lip aperture 60 can be positioned in the downwardly extending lip 56 of the seat to provide for attachment of a transverse bar 62 which assists in maintaining the distance between side members 54. Additional transverse bars 62 can optionally be positioned proximate to the front edge ,53 of the seat, proximate to the rear 52 of the seat and/or at the top of the backrest ,50. A bar pad 64 made of a soft, compressible material, such as neoprene foam, can cover the transverse bar 62 located at the top of the backrest 50 to protect the wall (not shown).

The only apertures in the side members 54 for mounting the side members 54 to the bracket 14 are in the downwardly extending lip 56, which is not subject to high bending stress. There are no apertures for mounting the side members 54 to the bracket 14 in high stress areas of the horizontal portion 44 (i.e., proximate to the horizontal portion 44 of the bracket 14) which reduce the bending strength of the resilient side members 54 or serve as "stress raisers." Thus, the resilient side members ,54 are stronger, more durable, and highly resistant to excessive bending and loading.

Typically, a seat cover 66 attaches to each side member 54 and extends horizontally to form the seat 16, while a backrest cover 68 attaches to the side members 54 vertically to form the backrest 50. The seat cover 66 and backrest cover 68 can be a fabric material such as a vinyl-coated polyester mesh which extends between the side members 54. Also, the seat cover 66 and backrest cover 68 can be padded or upholstered.

As shown in FIG. 4, the first fastener 18 comprises a countersunk bolt 70 which extends rearwardly through the seat lip aperture 58, a tubular spacer 72 which extends and fits over the countersunk bolt 70, and a mounting nut 74 for holding the countersunk bolt 70 in the seat lip aperture 58 with the spacer 72 extending rearwardly. In this embodiment, the mounting nut 74 and spacer 72 fit through the bracket lip aperture 46 to attach the downwardly extending lips of the seat 56 and bracket 42. Alternatively, (i) the thickness of the spacer 72 can be less than the thickness of the bracket 42 and the mounting nut 74 can be used to clamp the downwardly extending lip 56 of the seat to the downwardly extending lip 46 of the bracket 14 or (ii) the spacer 72 can be threaded (not shown); thereby eliminating the need for the mounting nut 74 to hold the spacer 72 onto the bolt 70.

In other embodiments, the first fastener 18 can be a rivet or another type of fastener which extends through the lip apertures 58 and supportably attaches itself to the downwardly extending lip 42 of the bracket or fixedly attaches the downwardly extending lip 42 of each bracket to the downwardly extending lip 56 of the seat 16. Optimally, the first fastener is made of a strong material such as steel.

As shown in FIG. 4, the second fastener 20 comprises a mounting insert 76; a mounting plate 78; a bumper 80; an adhesive 82 which attaches the mounting plate 78 to the outer, bottom surface of the side member 54; and a rear mounting screw 84, which extends upwardly through the bracket aperture 48 and is threaded into the mounting insert 76 which extends down through the bracket aperture 48 in the mounting plate.

The mounting insert 76 is a threaded female insert having an outer cross-section which is sized to fit in through the bracket aperture 48 and an outwardly tapering head 86. Optimally, the mounting insert 76 is made of a strong material such as steel. The mounting insert 76 is held perpendicular to the outer, bottom of the respective side member 54 by the mounting plate 78. Preferably, the mounting insert 76 is sufficiently long so that the rear mounting screw 84 tightens against the mounting insert 76 before the bumper 80 is completely compressed to allow the bumper 80 to absorb movement between the side member 54 and the bracket 14.

The mounting plate 78 is a flat plate having a depression 87 and a mounting aperture 88 for receiving and holding the mounting insert 76 by the tapered head 86. The mounting plate 78 is adhered to the outer, bottom surface of the side member 54 by the adhesive 82. Preferably, the mounting plate 78 is made of a resilient, strong material such as spring-tempered steel.

The adhesive 82 can be provided by a piece of very high bonding strength, flexible adhesive supplied in strip form as a piece of double-sided tape, i.e., 3M®, "VHB tape", or a resilient glue. Ideally, longitudinally reinforced one-sided tape (not shown) can be wrapped around the assembled side member 54 and mounting plate 78 to aid in securing the mounting plate 78 to the side member 54.

The bumper 80 is disposed between the horizontal portion 44 of the bracket and the side members 54 to minimize the concentration of point loads on the side members 54 and to quiet and dampen any contact between the side members 54 and the bracket 14. The bumper 80 can be made from a resilient, flexible material such as a resilient urethane. As shown in FIG. 4, the bumper 80 fits over the mounting insert 76 between the bracket aperture 48 and the mounting plate 78.

The rear mounting screw 84 is sized to fit the mounting insert 76 having a head 90 which is larger than the bracket aperture 48 to secure the bracket 14 to the mounting insert 76. A mounting washer 92 can be used between the head 90 of the rear mounting screw 84 and the bracket 14.

In operation, the brackets 14 are fixedly attached to the chair base frame 12, such as by welding. The first fastener 18 is positioned in the seat lip aperture 58 with the spacer 72 extending rearwardly. The spacer 72 is then inserted in the respective bracket aperture 48. The second fastener 20, which is attached by an adhesive 82 to the outer, bottom of the side member 54, extends through the bracket aperture 48 to hold the seat 16 in position. All apertures in the seat 16 used for mounting the seat 16 to the bracket 14 are located in the downwardly extending lip, 56.

The present invention provides a patient chair 10 which has a rearwardly flexing motion that responds to the user's movements and is comfortable for prolonged sittings. The significant advantage of this chair 10 is that the only apertures in the side members 54 used for mounting the side members 54 to the bracket 14 are in the downwardly extending lip 56 or are in areas not subjected to high bending stress. Thus, the side members 54 are able to better withstand prolonged, excessive flexing and loading. Moreover, the chair 10 is quickly and easily assembled because the spacer 72 fits quickly into the bracket lip aperture 46 and only the rear mounting screw 84 needs to be secured to attach the seat 16 to the chair base frame 12.

Although the present invention has been described in considerable detail with reference to certain preferred versions, other versions are possible. For example, the second fastener 20 can be a band (now shown) which wraps around each horizontal portion 44 of the bracket and each side member, 54. However, this version is less aesthetically pleasing because the seat cover 66 must be slotted to provide space for the band to slide over the bracket 14 and the side member 54 upon installation. Therefore the spirit and scope of the appended claims should not be limited to the description of the preferred versions contained herein.

What is claimed is:

1. A chair comprising:

(a) a chair base frame including a pair of substantially rigid, substantially vertical front legs spaced apart from each other;

(b) a rearwardly extending, substantially horizontal seat for supporting a human body in a seated position, the seat having a front edge with a downwardly extending lip;

(c) a pair of brackets for cantilevering the seat from the front edge, each bracket having a downwardly extending lip with a rearwardly extending, substantially horizontal portion and each bracket being fixedly attached to the chair base frame; and (d) a pair of first fasteners, each first fastener for attaching the downwardly extending lip of one of the brackets to the downwardly extending lip of the seat.

2. The chair of claim 1 further comprising a pair of second fasteners, each second fastener for attaching the horizontal portion of one of the brackets to an outer surface of the seat proximate to the front edge.

3. The chair of claim 2, wherein:

(a) the downwardly extending lip of the seat further comprises a seat lip aperture extending therethrough, and each first fastener is positioned in one of the seat lip apertures and is fixedly attached to the downwardly extending lip of one bracket; and (b) the horizontal portion of each bracket further comprises a bracket aperture extending therethrough, and each second fastener is positioned in one of the bracket apertures and is attached to an outer, bottom surface of the seat.

4. The chair of claim 3, wherein the second fastener is attached to the outer, bottom surface of the seat by an adhesive.

5. The chair of claim 3 wherein:

(a) the downwardly extending lip of each bracket includes a bracket lip aperture which extends through the bracket;

(b) the first fastener is fixedly positioned in the seat lip aperture and comprises a spacer extending rearwardly from the seat lip aperture;

(c) the bracket lip aperture in the bracket is a slot which has a larger cross-sectional area than the spacer to allow easy insertion of the spacer into the bracket lip aperture;

(d) the second fastener comprises:

i) a mounting insert;

ii) a mounting plate attached to the outer, bottom surface of the seat, the mounting plate having a mounting aperture for receiving and holding the mounted insert substantially perpendicular to the outer, bottom surface of the seat; and iii) a screw which extends upwardly through the bracket aperture and threads into the mounting insert.

6. The chair of claim 5, wherein each mounting plate is attached to the seat by an adhesive.

7. The chair of claim 1 further comprising a pair of bumpers, each bumper being positioned between the horizontal portion of one of the brackets and the seat.

8. The chair of claim 1, wherein the seat is capable of supporting at least two adult human bodies in the side-by-side seated position.

9. The chair of claim 1, wherein the seat comprises:

(a) a pair of substantially parallel, resilient side members, each side member being fixedly attached to one of the brackets; and (b) a seat cover attached horizontally between the side members.

10. The chair of claim 1 further comprising a pair of substantially parallel armrests, each armrest extending rearwardly from one of the legs above the brackets.

11. The chair of claim 1 further comprising a backrest affixed to the seat at a rear edge and extending vertically above the seat for providing support for an individual sitting upon the seat.

12. The chair of claim 11, wherein the seat and the backrest comprise:

(a) a pair of continuous, substantially parallel, resilient side members;

(b) a seat cover attached horizontally between the side members; and (c) a back cover attached vertically between the side members.

13. The chair of claim 12, wherein the side members are constructed of spring steel.

14. A chair comprising:

(a) a chair base frame having at least two substantially rigid, substantially vertical front legs spaced apart from each other by a substantially horizontal cross-beam; and (b) at least one substantially horizontal, rearwardly extending seat fixedly attached to and cantilevering from the chair base frame for supporting a human body in a seated position, each seat comprising:

i) at least one substantially horizontal, resilient side member, each side member having a front edge with a downwardly extending lip;

ii) at least one bracket for cantilevering each side member from the front edge, each bracket having a downwardly extending lip with a rearwardly extending, substantially horizontal portion, and each bracket being fixedly attached to the chair base frame;

iii) at least one first fastener, each first fastener for attaching the downwardly extending lip of one bracket to the downwardly extending lip of one side member; and iv) at least one second fastener, each second fastener for attaching the horizontal portion of one bracket to an outer surface of one side member proximate to the front edge.

15. The chair of claim 14, wherein each seat comprises:

(a) a pair of substantially horizontal, substantially parallel, resilient side members, each side member having a front edge with a downwardly extending lip;

(b) a seat cover attached horizontally between the side members;

(c) a pair of brackets for cantilevering the side members from the front edges, each bracket having a downwardly extending lip with a rearwardly extending, substantially horizontal portion, and each bracket being fixedly attached to the chair base frame;

(d) a pair of first fasteners, each first fastener for attaching the downwardly extending lip of one of the brackets to the downwardly extending lip of one of the side members; and (e) a pair of second fasteners, each second fastener for attaching the horizontal portion of one of the brackets to an outer surface of one of the side members proximate to the front edge.

16. The chair of claim 15, wherein:

(a) the downwardly extending lip of each bracket, and the downwardly extending lip of each of the side members further comprises a lip aperture extending therethrough, and each first fastener is positioned in one of the lip apertures; and (b) the horizontal portion of each bracket further comprises an aperture extending therethrough, and each second fastener is positioned in the aperture in one of the brackets and is adhered to the outer surface of one of the side members.

17. The chair of claim 16 wherein:

(a) each lip aperture in the bracket and the side member comprises a bracket lip aperture which extends through the bracket and a seat lip aperture which extends through the seat;

(b) the first fastener is fixedly positioned in the seat lip aperture and comprises a spacer extending rearwardly from the seat lip aperture;

(c) the bracket lip aperture in the bracket is a slot which has a larger cross-sectional area than the spacer to allow easy insertion of the spacer into the bracket lip aperture;

(d) the second fastener comprises:

i) a mounting insert;

ii) a mounting plate adhered to the outer, bottom surface of one of the side members, the mounting plate having a mounting aperture for receiving and holding the mounted insert substantially perpendicular to the outer, bottom surface of the respective side member;

iii) a bumper positioned between the bracket and the side member; and iv) a screw which extends upwardly through the bracket aperture and threads into the mounting insert.

18. The chair of claim 17, wherein each mounting plate is adhered to one of the side members by an adhesive.

19. The chair of claim 15 further comprising substantially parallel armrests affixed to the chair base frame extending rearwardly above each bracket.

20. The chair of claim 15 further comprising a backrest affixed to each seat at a rear edge and extending vertically above the side members for providing back support for an individual sitting upon the seat.

21. The chair of claim 20, wherein the seat and the backrest comprise:

(a) a pair of continuous, substantially parallel, resilient side members;

(b) a seat cover attached horizontally between the side members; and (c) a backrest cover attached vertically between the side members.

22. A chair comprising:

(a) a chair base frame including a pair of substantially rigid, substantially vertical front legs spaced apart from each other;

(b) a pair of rearwardly extending, substantially parallel, spring steel side members, each side member having a substantially horizontal portion, the horizontal portion having a front edge with a downwardly extending lip and a rear edge with a substantially vertical portion;

(c) a seat cover attached horizontally between the side members;

(d) a back cover attached vertically between the side members;

(e) a pair of brackets for cantilevering the side members from the front edges, each bracket having a downwardly extending lip with a rearwardly extending, substantially horizontal portion and each bracket is fixedly attached to the chair base frame;

(f) a pair of first fasteners, each first fastener for attaching the downwardly extending lip of one of the brackets to the downwardly extending lip of one of the side members;

(g) a pair of second fasteners, each second fastener for attaching the horizontal portion of one of the brackets to an outer surface of one of the side members proximate to the front edge;

(h) a pair of substantially parallel armrests, each armrest extending rearwardly from one of the legs above the brackets; and (i) a pair of bumpers, each bumper being positioned between the horizontal portion of one of the brackets and one of the side members;

wherein, the downwardly extending lip of each bracket, and the downwardly extending lip of each of the side members further comprises a lip aperture extending therethrough, and each first fastener is positioned in one of the lip apertures; wherein, the horizontal portion of each bracket further comprises an aperture, and each second fastener is positioned in the aperture in one of the brackets and is adhered to the outer surface of one of the side members.

23. The chair of claim 22 wherein:

(a) each lip aperture in the bracket and the side member comprises a bracket lip aperture which extends through the bracket and a seat lip aperture which extends through the side member;

(b) the first fastener is fixedly positioned in the seat lip aperture and comprises a spacer extending rearwardly from the seat lip aperture;

(c) the bracket lip aperture in the bracket is a slot which has a larger cross-sectional area than the spacer to allow easy insertion of the spacer into the bracket lip aperture;

(d) the second fastener comprises:

i) a mounting insert;

ii) a mounting plate adhered to the outer, bottom surface of one of the side members, the mounting plate having a mounting aperture for receiving and holding the mounted insert substantially perpendicular to the outer, bottom surface of the respective side member; and iii) a screw which extends upwardly through the bracket aperture and threads into the mounting insert;

(e) the bumper is positioned over the mounting insert between the bracket aperture and the mounting plate; and (f) each mounting plate is adhered to one of the side members by an adhesive.

* * * * *

UNITED STATES PATENT AND TRADEMARK OFFICE

CERTIFICATE OF CORRECTION

PATENT NO. : 5,551,758

DATED : September 3, 1996

INVENTOR(S) : Roger K. Leib, James L. Reinis

It is certified that error appears in the above-identified patent and that said Letters Patent is hereby corrected as shown below:

Title Page, Section [73], the Assignee should read --Roger and Bonita Leib Trust, Los Angeles, California--.

Column 3, line 22, "racket" should read --bracket--.

Column 4, line 60, ", 53" should read --53--; and

Column 4, line 61, ",50" should read --50--.

Column 5, line 7, ",54" should read --54--.

Column 6, line 31, "lip," should read --lip--.

Signed and Sealed this

Twenty-first Day of January, 1997

*Attest:*

*Attesting Officer*

Bruce Lehman

BRUCE LEHMAN

*Commissioner of Patents and Trademarks*